US009808858B2

(12) United States Patent
Wang et al.

(10) Patent No.: US 9,808,858 B2
(45) Date of Patent: Nov. 7, 2017

(54) METHOD TO IMPROVE RISER FEEDABILITY FOR SEMI-PERMANENT MOLD CASTING OF CYLINDER HEADS

(71) Applicant: GM Global Technology Operations LLC, Detroit, MI (US)

(72) Inventors: Qigui Wang, Rochester Hills, MI (US); Christopher D. Cogan, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 182 days.

(21) Appl. No.: 14/884,259

(22) Filed: Oct. 15, 2015

(65) Prior Publication Data

US 2017/0106434 A1 Apr. 20, 2017

(51) Int. Cl.
*B22C 9/08* (2006.01)

(52) U.S. Cl.
CPC ..... *B22C 9/088* (2013.01)

(58) Field of Classification Search
CPC ..... B22C 9/088
USPC ..... 164/133, 359
See application file for complete search history.

(56) References Cited

U.S. PATENT DOCUMENTS 6,698,494 B1 * 3/2004 Hansen ..... B22D 18/04 164/133
8,267,151 B2 * 9/2012 Chu ..... B22C 9/10 164/339

FOREIGN PATENT DOCUMENTS

JP 10328812 A * 12/1998
JP 2010269345 A * 12/2010

OTHER PUBLICATIONS

EPO machine translation of JP 10-328812, dated Dec. 15, 1998.*

* cited by examiner

*Primary Examiner* — Kevin E Yoon

(57) ABSTRACT

A method of improving riser feedability in semi-permanent mold casting is disclosed. The method includes providing a first receptacle fluidly connected to a mold cavity and providing a second receptacle fluidly connected to a riser. Further, the method includes delivering molten metal to the first receptacle and conveying the molten metal into the mold cavity through a sprue. Delivery of molten metal to the first receptacle is terminated when the mold cavity reaches a predetermined fill level delivery of molten metal to the second receptacle is initiated. In certain embodiments, the first receptacle and the second receptacle are combined into a single receptacle and the sprue is connected to the mold cavity through a lower runner and is connected to the riser through an upper runner.

10 Claims, 3 Drawing Sheets

METHOD TO IMPROVE RISER FEEDABILITY FOR SEMI-PERMANENT MOLD CASTING OF CYLINDER HEADS

BACKGROUND TO THE INVENTION

This disclosure relates generally to an improved way to pour molten metal used in a semi-permanent mold casting operation, and more particularly to improving riser feedability to reduce defects in the casting upon cooling.

Casting is a metal shaping process characterized by pouring a molten metal into a mold and allowing it to solidify. One of the advantages of metal casting is that the resulting product can virtually have any configuration. Although casting offers many benefits, it suffers from difficulties in quality of the finished cast articles due to incidents of formation of a shrinkage cavity (hot spot), cold shuts, or misrun. Most metals are less dense as a liquid than as a solid so castings naturally shrink upon cooling. The natural shrinkage of liquid metal during solidification can leave a void at the last point to solidify called a shrinkage cavity.

To reduce the occurrence of shrinkage cavity formation, casting systems frequently include one or more risers. A riser, also known as a feeder, is a reservoir built into a metal casting mold to prevent cavities due to shrinkage. Excess molten metal flows into the riser during mold filling. The additional molten metal is needed to compensate for contractions or shrinkage of the molten metal, which occur during the casting process. Metal from the riser fills such voids created in the casting when metal from the casting contracts. In order to fill voids left from metal contraction, the metal from the riser must remain in a liquid state for a longer period of time than the bulk casting. An optimal design of riser will help in reducing shrinkage cavities by ensuring that molten metal can readily flow into the casting when the need arises.

However, risers are only effective if three conditions are met: the riser cools after the casting, the riser has enough material to compensate for the casting shrinkage, and the casting directionally solidifies towards the riser. For the riser to cool after the casting, the riser must cool more slowly than the casting. In current production of semi-permanent mold casting of cylinder heads for example, a bottom fill or a side fill gating design and a heavy open riser are typically used. During mold fill, the molten metal flows through the casting cavity with the riser being the last section to fill. As a result, the temperature of the molten metal in the riser is generally low and riser feedability is significantly reduced because the molten metal losses heat when it passes through the casting cavity.

There is a continuing need for a method of improving riser feedability to allow for improved back filling of the mold cavity with molten metal to prevent shrinkage cavity formation during solidification and associated shrinkage of the bulk metal in the casting cavity.

SUMMARY OF THE INVENTION

It is against the above background that embodiments of the present disclosure generally relate to methods of improving riser feedability in semi-permanent mold casting. According to a first aspect of the present disclosure, a method of improving riser feedability in semi-permanent mold casting includes providing a first receptacle fluidly connect to a mold cavity and providing a second receptacle fluidly connected to a riser. The method further includes delivering molten metal to the first receptacle. Additionally, the method includes conveying the molten metal that has been delivered to the first receptacle into the mold cavity through a sprue. Subsequently, the method includes terminating delivery of the molten metal to the first receptacle when the mold cavity reaches a predetermined fill level. Finally, the method includes delivering molten metal to the second receptacle upon terminating delivery of molten metal to the first receptacle.

According to another aspect of the present disclosure, a method of improving riser feedability in semi-permanent mold casting includes providing a receptacle fluidly connected to a mold cavity through a sprue and a lower runner. Further, the method includes providing an upper runner to form a fluid connection between the sprue and a riser. The method additionally includes delivering molten metal to the receptacle and conveying the molten metal that has been delivered to the receptacle into the mold cavity through the sprue and the lower runner. Finally, the method includes conveying the molten metal to the riser through the upper runner.

BRIEF DESCRIPTION OF THE DRAWINGS

The following detailed description of the preferred embodiments of the present disclosure can be best understood when read in conjunction with the following drawings, where like structure is indicated with like reference numerals and in which.

DETAILED DESCRIPTION OF THE PREFERRED EMBODIMENTS

Figure 1:
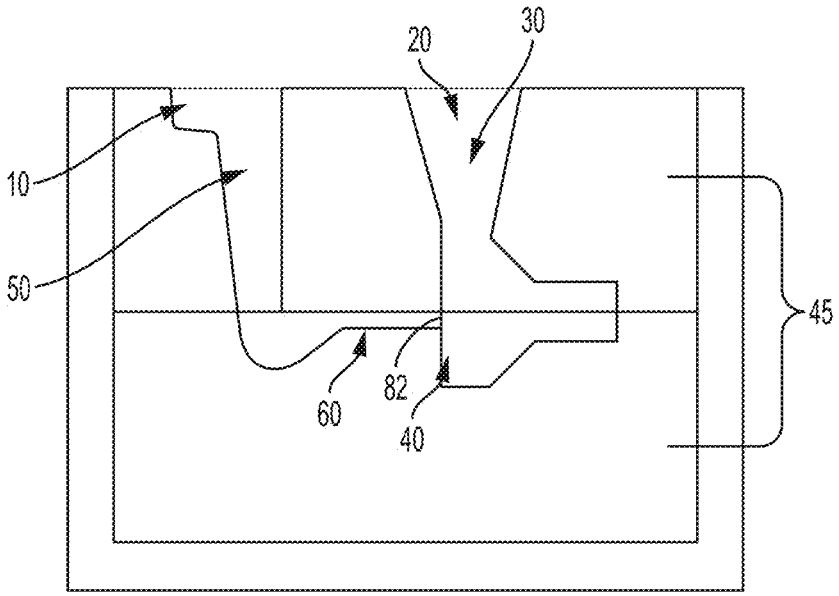
FIG. 1 is a schematic view of the interior of a casting mold according to aspects of the present disclosure.

A method of improving riser feedability in semi-permanent mold casting helps overcome and alleviate problems associated with shrinkage cavity formation in the final cast piece. Specifically, the method helps ensure the molten metal forming the riser cools after the bulk casting to allow the molten metal in the riser to compensate for shrinkage of the casting during cooling and solidification.

Risers are not needed for casting processes that utilize pressure to fill the mold cavity. Such pressurized casting processes include, but are not limited to, high pressure die casting, squeeze casting, and low pressure die casting. As such, pressurized casting processes are distinct and do not require the methods of improving riser feedability in semi-permanent mold casting discussed in this disclosure. The semi-permanent mold casting discussed in this disclosure relies upon gravity to feed and fill casting mold and form the final casting.

The method in accordance with at least one embodiment includes providing a first receptacle 10 fluidly connected to a mold cavity 40 in a casting mold 45 and a second receptacle 20 fluidly connected to a riser 30. Molten metal is initially delivered to the first receptacle 10. The molten metal delivered to the first receptacle 10 is conveyed into the mold cavity 40 through a sprue 50. The molten metal delivered to the mold cavity 40 through the sprue 50 fills the mold cavity 40. Once the mold cavity 40 has been filled to a predetermined fill level, the flow of molten metal to the first receptacle 10 is terminated and delivery of the molten metal to the second receptacle 20 is initiated. The molten metal provided to the second receptacle 20 fills the riser 30 and serves to compensate for shrinkage of the casting during cooling and solidification.

With reference to FIG. 1, the first receptacle 10 is fluidly connected to the mold cavity 40. In at least one embodiment, the first receptacle 10 is connected to the mold cavity 40 by a sprue 50. In further embodiments, the sprue 50 is connected to the mold cavity 40 by a runner 60. In accordance with standard definitions and understanding within the casting industry, a sprue is the generally vertical passage through which liquid material is introduced into a mold, while a runner is the generally horizontal passage connecting the sprue to gates that in turn lead to individual casting cavities such as a cope or a drag.

Figure 2:
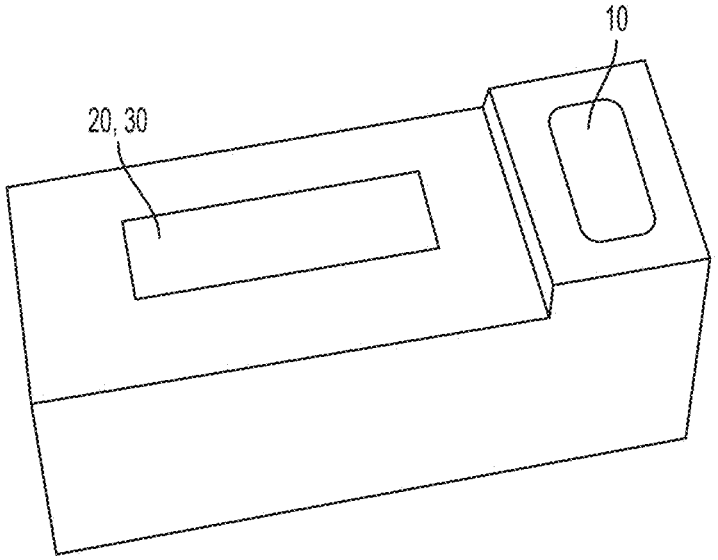
FIG. 2 is a perspective view of a casting mold according to an aspect of the present disclosure.

The first receptacle 10 may be any reservoir configured to accept molten metal for delivery to the mold cavity 40. For example, the first receptacle may be a pouring basin or a pouring cup, The second receptacle 20 is fluidly connected to the riser 30. With referenced to FIG. 2, in at least one embodiment, the second receptacle 20 is an open top of the riser. In such embodiments, the riser 30 extends through the casting mold 45 to create an opening in the exterior wall of the casting mold 45 which directly connects to the riser 30. Molten metal may be delivered directly into the riser 30 through the open top of the riser. Directly delivering the molten metal to the open top of the riser (second receptacle 20) provides the benefit of the molten metal in the riser 30 being at maximum temperature and thus remaining liquid to fill any shrinkage cavity formed as the casting solidifies and contracts.

In at least one embodiment, the first receptacle 10 and the second receptacle 20 are immediately adjacent. In this context immediately adjacent means that the first receptacle 10 and second receptacle 20 are located side-by-side with a distance of less than 50 mm separating the first receptacle 10 from the second receptacle 20. Immediately adjacent also includes the instance where a single pouring basin, or other receptacle known to one skilled in the art, is divided to form the first receptacle 10 and the second receptacle 20. Placement of the first receptacle 10 and the second receptacle 20 in close proximity allows for a quick transition from delivering molten metal to the first receptacle 10 and delivering molten metal to the second receptacle 20. In various embodiments, the transition from delivering molten metal to the first receptacle 10 and delivering molten metal to the second receptacle 20 is completed within 10 seconds, within 5 seconds, and within 3 seconds.

Figure 3:
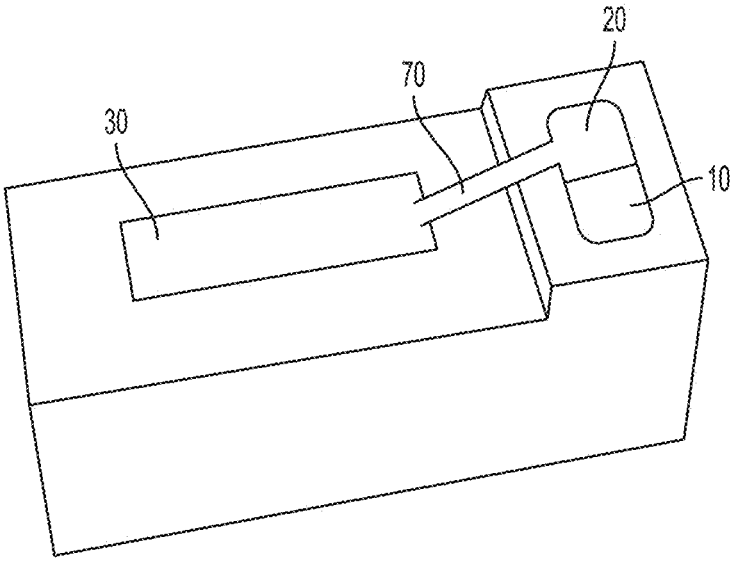
FIG. 3 is a perspective view of a casting mold according to another aspect of the present disclosure.

In multiple embodiments, the molten metal delivered to the second receptacle 20 is conveyed to the riser 30. With reference to FIG. 3, in at least one embodiment, the molten metal is conveyed from the second receptacle 20 to the riser 30 via a spillway 70. For example, molten metal in the second receptacle 20 may traverse a channel or flume connecting the second receptacle 20 to the riser 30. In one or more embodiments, the spillway 70 may be closed to prevent oxidation of the molten metal during filling. Additionally, the spillway 70 may comprise exothermal materials that help maintain or even increase the temperature of the molten metal.

Figure 4:
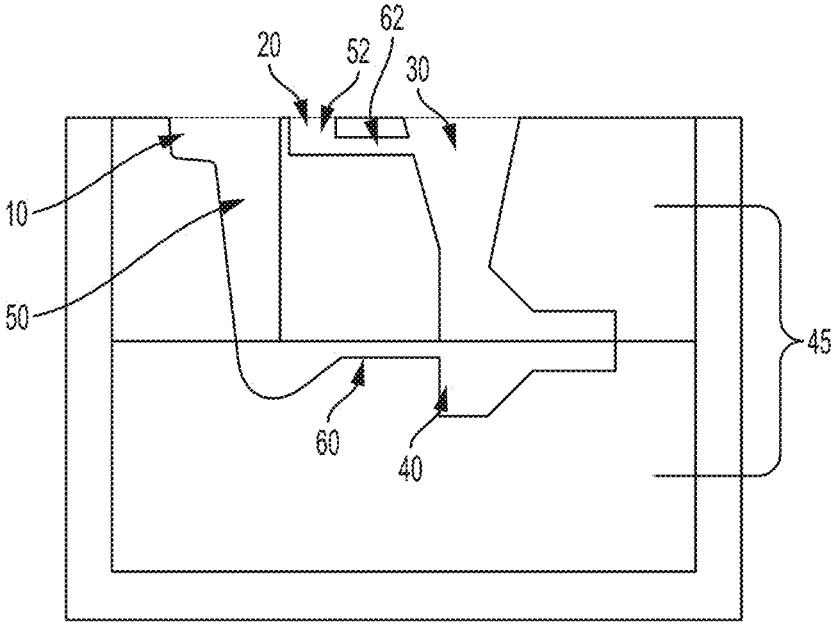
FIG. 4 is a schematic view of the interior of a casting mold according to aspects of the present disclosure.

With reference to FIG. 4, in at least one embodiment, the molten metal is conveyed from the second receptacle 20 to the riser 30 through a second sprue 52 and second runner 62. For example, the molten metal is provided to the second receptacle 20 which is fluidly connected to the riser 30 with a second sprue 52 and second runner 62 which conveys the molten metal into the riser 30. In various embodiments, the second sprue 52 is connected to the riser 30 via the second runner 62 near the open top of the riser, near the mold cavity 40, or any location disposed therebetween. Locating the connection of the second sprue 52 and second runner 62 near the mold cavity 40 allows the riser 30 to fill from the bottom, whereas locating the connection of the second sprue 52 and second runner 62 near the open top of the riser allows for fresh molten metal to continually be added to the top of the riser 30 as the riser 30 fills.

With a traditional casting system the molten metal fills the mold cavity 40 from the bottom up. The leading edge or surface of the molten metal advances as the mold cavity 40 fills and fresh molten metal is added to the mold cavity 40. During filling of the mold cavity 40, the riser 30 is the last section to fill and thus is generally filled with molten metal that was introduced to the casting mold 45 near the beginning of the casting process. As a result, the temperature of the molten metal in the riser 30 is generally low and riser feedability is significantly reduced because the molten metal lost heat in passing through the mold cavity 40. While the actual temperature drop of the molten metal depends upon the casting weight and geometry, a drop of 10 to 50° C. is typical. Utilization of embodiments of the present disclosure allows the riser 30 to be filled with fresh molten metal which has not suffered heat loss passing through the mold cavity 40. The molten metal in the riser 30 thus remains molten longer after filling of the casting mold 45 and is able to flow into the mold cavity 40 longer to fill shrinkage cavity formation during solidification of the casting.

Providing molten metal to the riser 30 without passage of the molten metal through the mold cavity 40 improves the riser feedability and the quality of the resultant casting. For example, in production of a semi-permanent mold casting of a cylinder head for an engine, the riser feedability and porosity of the resultant cast cylinder head are each improved. Specifically, with reference to FIG. 2, when the molten metal is delivered directly into an open top of the riser, the metal temperature in the riser 30 may be increased by at least 20° C. when casting a cylinder head. As a result of the increased temperature of the molten metal when delivered to the riser 30, for the same riser 30 configuration in combination with the same mold cavity 40, the riser feedability is improved by 10%. The 10% improvement in riser feedability provides an additional 50 seconds until the molten metal in the riser 30 is fully solidified and as a result additional time is provided for molten metal in the riser to backfill the casting during solidification. The improved riser feedability allows the porosity level in the casting to be reduced by at least 10% as well. Similarly, with reference to FIGS. 3 and 4, when the molten metal is delivered into a second receptacle 20 and conveyed directly to the riser 30, the metal temperature in the riser 30 may be increased by at least 10° C. when casting a cylinder head. As a result of the increased temperature of the molten metal when delivered to the riser 30, for the same riser configuration in combination with the same mold cavity 40, the riser feedability is improved by 5 to 10%. The 5 to 10% improvement in riser feedability provides at least an additional 25 seconds until the molten metal in the riser 30 is fully solidified. As a result, additional time is provided for molten metal in the riser 30 to backfill the casting during solidification. The improved riser feedability allows the porosity level in the casting to be reduced by at least 5% as well.

An integrated backflow prevention mechanism may also be included in the casting system. The integrated backflow prevention mechanism may be activated upon terminating delivery of the molten metal to the first receptacle 10 when the mold cavity 40 reaches a predetermined fill level. The integrated backflow prevention mechanism functions to prevent back flow of the metal front upon termination of delivery of molten metal to the first receptacle 10. Additionally, the integrated backflow prevention mechanism provides prevention of back flow of the metal front upon initiation of delivery of molten metal to the second receptacle 20 and the riser 30. As molten metal fills the riser 30, the head pressure provided by the molten metal in the riser 30 increases, resulting in the molten metal in the sprue 50 trying to back flow out to reach equilibrium. Preventing back flow of the molten metal front helps improve metal yield by allowing the level of the molten metal in the sprue 50 to be below the level of molten metal in the riser 30. Without a backflow prevention mechanism, the level of molten metal in the sprue 50 and the riser 30 would coordinate such that a gravitational equilibrium was reached.

In various embodiments, with reference to FIG. 1, the backflow prevention mechanism is a slide gate 82 which closes the opening between the runner 60 and the mold cavity 40. In further embodiments, the slide gate 82 may be positioned to close the opening between the sprue 50 and the first receptacle 10, the opening between the sprue 50 and the runner 60, a position along the sprue 50, or a position along the length of the runner 60. The slide gate 82 may be positioned anywhere along the pathway providing molten metal to the mold cavity 40 to prevent back flow of the molten metal.

Figure 5:
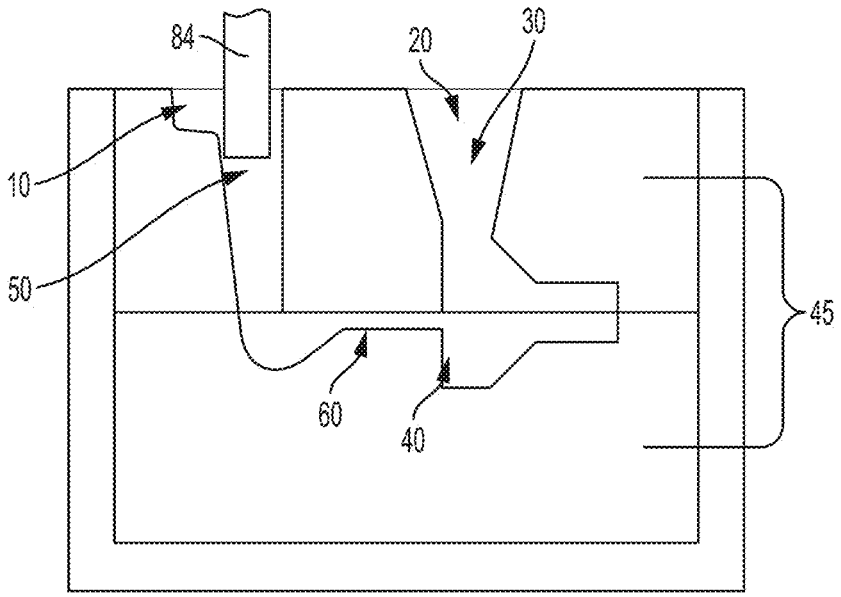
FIG. 5 is a schematic view of the interior of a casting mold according to aspects of the present disclosure.

With reference to FIG. 5, in further embodiments, the integrated backflow prevention mechanism is a hydraulic ram 84 positioned to advance the molten metal along the sprue 50. Upon terminating delivery of the molten metal to the first receptacle 10 when the mold cavity 40 reaches a predetermined fill level, the hydraulic ram 84 may continue advancing the molten metal front while additional molten metal is delivered to the second receptacle 20 and the riser 30. Additionally, the hydraulic ram 84 serves to prevent backflow of the molten metal in the sprue 50 as molten metal is added to the riser 30.

In at least one embodiment, the sprue 50 is fluidly connected in at least one location to a gravitational bottom of the mold cavity 40 during filling. For purposes of this disclosure, a gravitational bottom is the lowest side with respect to gravity. As such, molten metal provided to the mold cavity 40 would enter the lowest point in the mold cavity 40 and progressively fill the mold cavity 40 from the bottom.

In at least one embodiment, the sprue 50 is fluidly connected in at least one location to a gravitational side of the mold cavity 40 during filling. For purposes of this disclosure, a gravitational side is the side of the mold cavity 40 when the lowest side with respect to gravity is defined as the bottom. As such, molten metal provided to the mold cavity 40 would enter the side of the mold cavity 40.

The method in accordance with at least one embodiment includes providing a single receptacle 100 fluidly connected to the mold cavity 40 and the riser 30. The single receptacle 100 is connected to the mold cavity 40 through the sprue 50 and a lower runner 160. Similarly, the single receptacle 100 is also connected to the riser 30 through the sprue 50 and an upper runner 162. The method further includes delivering molten metal to the single receptacle 100 and conveying the molten metal which has been delivered to the single receptacle 100 into the mold cavity 40 through the sprue 50 and the lower runner 160. Subsequently, as additional molten metal is delivered to the single receptacle 100, the molten metal is conveyed to the riser 30 through the upper runner 162.

Figure 6:
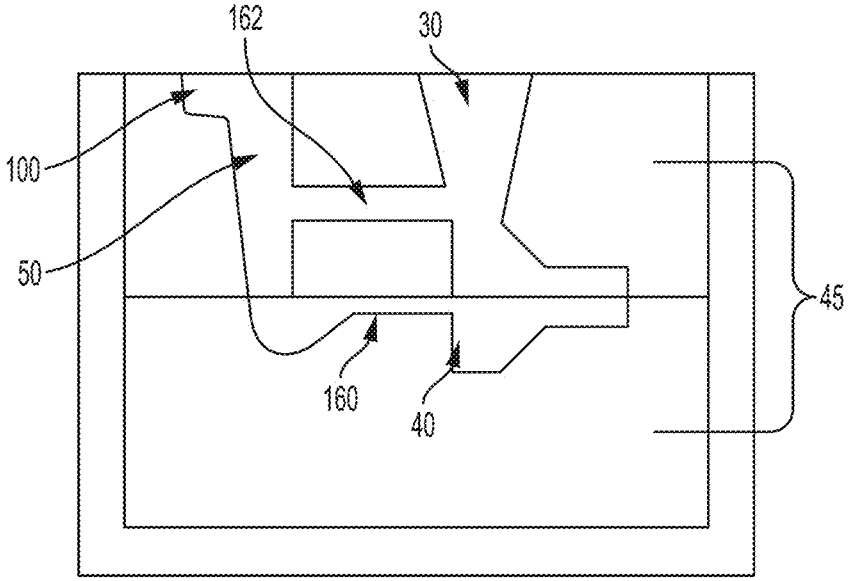
FIG. 6 is a schematic view of the interior of a casting mold according to aspects of the present disclosure.

With reference to FIG. 6, the single receptacle 100 is fluidly connected to both the mold cavity 40 and the riser 30. The sprue 50 is connected to the mold cavity 40 by the lower runner 160 and is connected to the riser 30 by the upper runner 162. The upper runner 162 is positioned proximal the single receptacle 100 relative to the lower runner 160 along the length of the sprue 50. Thus, as molten metal is delivered to the single receptacle 100 and is conveyed along the sprue 50 by gravity, the molten metal initially traverses through the lower runner 160 into the mold cavity 40. The molten metal continues to be conveyed through the lower runner 160 until the mold cavity 40 is full or reaches a desired fill level and then the molten metal is conveyed from the sprue 50 through the upper runner 162 directly into the riser 30. As the mold cavity 40 initially fills with molten metal, the level of molten metal in the sprue 50 also rises. Upon filling the mold cavity 40 to a level sufficient that the molten metal in the sprue 50 rises to the level of the upper runner 162, molten metal flows through the upper runner 162 and into the riser 30.

In at least one embodiment, the molten metal is transferred into the first receptacle 10, the second receptacle 20, and/or the single receptacle 100 with a ladle. A ladle traditionally operates by dipping the ladle into a crucible, dip well, or related device containing molten metal to capture a sufficient quantity of the molten metal in a hollow interior of the ladle for transport to the casting mold 45. Molten metal is then delivered to the casting mold 45 by emptying the ladle. Many different designs for dipping/pouring ladles exist and are used throughout the foundry industry. The designs are normally chosen based upon the type of molten metal and casting mold 45 used. Commonly used ladles make use of a slot, a lip and a baffle, or a dam at the top of the ladle to reduce inclusion of furnace metal oxides during metal filling, or the ladle may incorporate a stopper rod to control the flow of metal into and out of the ladle. Further, variations in particular ladles would be known to one having skill in the art.

One skilled in the art would appreciate that a variety of different materials may be utilized in semi-permanent mold casting. Non-limiting examples of materials for casting include alloys of aluminum, magnesium, titanium, cast steel, copper alloy, super alloy (Ni alloy), or iron as well as elemental aluminum, magnesium, titanium, or iron. All metals capable of casting are envisioned. In at least one embodiment, aluminum as an alloy or elementally pure is utilized in the semi-permanent mold casting process.

Semi-permanent mold casting is a versatile process allowing a variety of different items to be cast. Non-limiting examples include transmission pump housings, rotor housings, control arms, and water inlets. In at least one embodiment, the methods of this disclosure are utilized to cast an engine cylinder head.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present disclosure. Moreover, the term "substantially" is utilized herein to represent the inherent degree of uncertainty that may be attributed to any quantitative comparison, value, measurement, or other representation. As such, it may represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of improving riser feedability in semi-permanent mold casting, the method comprising:

providing a first receptacle fluidly connected to a mold cavity;

providing a second receptacle fluidly connected to a riser;

delivering molten metal to the first receptacle;

conveying the molten metal that has been delivered to the first receptacle into the mold cavity through a sprue;

terminating delivery of the molten metal to the first receptacle when the mold cavity reaches a predetermined fill level;

delivering molten metal to the second receptacle upon terminating delivery of molten metal to the first receptacle; and conveying the molten metal that has been delivered to the second receptacle into the riser via a spillway.

2. The method of claim 1, wherein the second receptacle is an open top of the riser.

3. The method of claim 1, wherein the first receptacle and the second receptacle are immediately adjacent.

4. The method of claim 1, wherein the mold cavity is configured to form an engine cylinder head.

5. The method of claim 1, wherein the sprue comprises an integrated backflow prevention mechanism activated upon terminating delivery of the molten metal to the first receptacle when the mold cavity reaches a predetermined fill level.

6. The method of claim 5, wherein the integrated backflow prevention mechanism is a slide gate.

7. The method of claim 6, wherein the slide gate is positioned as to close the opening between the sprue and the first receptacle.

8. The method of claim 6, wherein the integrated backflow prevention mechanism is a hydraulic ram positioned to advance the molten metal along the sprue between terminating delivery of the molten metal to the first receptacle when the mold cavity reaches a predetermined fill level and delivering molten metal to the second receptacle upon terminating delivery of molten metal to the first receptacle.

9. The method of claim 1, wherein the sprue is fluidly connected in at least one location to a gravitational bottom of the mold cavity during filling.

10. The method of claim 1, wherein the sprue is fluidly connected in at least one location to a gravitational side of the mold cavity during filling.

* * * * *